United States Patent [19]

Yuda et al.

[11] 4,008,105

[45] Feb. 15, 1977

[54] MAGNETIC MATERIALS

[75] Inventors: Sumio Yuda; Tohru Sawada; Kohji Moriya, all of Warabi, Japan

[73] Assignee: Warabi Special Steel Co., Ltd., Warabi, Japan

[22] Filed: Apr. 22, 1975

[21] Appl. No.: 570,475

[52] U.S. Cl. ..... 148/101; 75/126 H; 148/31.57

[51] Int. Cl.[2] ..... H01F 1/02

[58] Field of Search ..... 75/126 H, 0.5 AA, 126 F, 75/176; 148/31.57, 100, 101, 105, 31.55

[56] References Cited

UNITED STATES PATENTS

| | | | |
|---|---|---|---|
| 3,600,162 | 8/1971 | Kaplan et al. | 75/126 H |
| 3,634,072 | 1/1972 | Ackermann et al. | 75/31.55 |
| 3,806,336 | 4/1974 | Kaneko et al. | 75/126 H |

*Primary Examiner*—Walter R. Satterfield
*Attorney, Agent, or Firm*—Laurence R. Brown

[57] ABSTRACT

In magnet alloy of spinodal decomposition type comprising Fe-Cr-Co or Fe-Cr-Co-Si system, magnetic materials containing Zr in an amount from 0.03 to 3.5%.

Such magnetic materials are embodied by containing Zr in an amount from 0.03 to 3.5% by weight in an alloy system comprising Co from 10 to 35% and Cr from 25 to 40%, the balance being Fe or in an alloy system comprising Co from 10 to 35%, Cr from 25 to 40% and Si from 0.3 to 2.0%, the balance being Fe.

5 Claims, 5 Drawing Figures

MAXIMUM ENERGY PRODUCT (M.G.Oe)
5.5
5.0
4.5
4.0
3.5
3.0
2.5
COERCIVE FORCE (Oe)
800
780
760
740
720
700
680
660
640
RESIDUAL MAGNETIC FLUX DENSITY (G)
13000
12000
11000
10000
9000
8000
0
0.5
1.0
1.5
2.0
2.5
3.0
3.5
Zr CONTENT (%)

MAGNETIC MATERIALS

DETAILED DESCRIPTION OF THE INVENTION

This invention relates to an improvement in iron-chromium-cobalt alloy and iron-chromium-cobalt-silicon alloy known as the spinodal decomposition magnet alloy.

Commercially available permanent magnet alloys which have been widely employed include permanent magnet alloys of alnico type and barium-ferrite type. Since the former has a relatively higher magnetic flux density and a higher energy product, it has occupied the premier position of permanent magnets for a long time of about 40 years in past.

Since the latter is characterized by a higher coercive force and a low cost, it has been employed in an amount as much as the former, although it has been developed considerably later than the former.

However, the alloy of alnico type cannot be produced other than by molding due to its high hardness and brittleness. Moreover, since it is difficult machine finishing except by grinding, it has a disadvantage in that the production efficiency and configuration are limited.

On the other hand, barium-ferrite magnet is similarly hard and brittle so that the machine working is more difficult. In addition, since it is produced by powder molding process, the configuration is limited similar to the alnico type.

Alloys of Fe-Cr-Co and Fe-Cr-Co-Si systems have been introduced to overcome such shortcomings of the above-mentioned types. Their magnetic characteristics can be compared with those of alnico alloy. Since they can be not only molded but also worked by plastic workings such as hot-rolling, cold-rolling, drawing, pressing and the like from the ingot, the production efficiency is very high. Hence they will be expected to be produced and consumed commercially as compared with or superior to the above-mentioned two types.

However, when the alloys of Fe-Cr-Co and Fe-Cr-Co-Si types are produced on commercial level, it has been recognized that since it is not long since such alloys have been introduced, there are a number of problems to be improved.

Such problems will be now illustrated:

i. Since the magnetic characteristics are poor when $\gamma$-phase is retained in the $\alpha$-phase in the metallurgical structure, the alloys of such types should be rapidly cooled after maintained at a high temperature of higher than 1300° C. Namely, they should be converted into single $\alpha$-phase by the solution heat treatment to convert the structure into single $\alpha$-phase (referred to hereinafter as solution heat treatment).

Since the maintenance at a temperature of higher than 1300° C as a commercial practice results in a short life of the heating equipments due to the wear of refractories thereof, an increased heat demand and an insufficient efficiency due to a prolonged heating period up to the desired temperature, the production cost becomes higher and the production efficiency becomes lower. Hence it is desirable to develope a process capable to treat articles at lower temperatures.

ii. As set force in Paragraph (i), the alloys of these types necessitates to be composed of single $\alpha$-phase, thus to be maintained at a higher temperature. It is further essential to cool them rapidly from the higher temperature. If they are cooled slowly, $\gamma$-phase appears during the cooling to deteriorate the magnetic characteristics thereof. Thus no single $\alpha$-phase can be obtained eventually so that no desired characteristics can be expected. For such a reason, they have been cooled rapidly to inhibit the development of $\gamma$-phase at present by cooling them by throwing into ice water after having been maintained at the higher temperature.

Even when such a cooling process is employed for cooling articles having a large thickness, the periphery portions are cooled rapidly, but the inner portions cannot be cooled so rapidly but they are cooled slowly in the formation of $\gamma$-phase. This is called mass effect in which deterioration of the magnetic characteristics cannot be avoidable for articles having a relatively larger thickness.

iii. As set forth hereinabove, the alloys of these types necessitate the solution heat treatment at a higher temperature, so that they are characterized by a large grain size of the alloy crystals after the treatment. It has already been indicated that since a large grain size is generally resulted in a low breaking resistance in the subsequent cold workings, the working limit is so small that the working efficiency is insufficient.

When the alloys of these types are cold drawn or cold wiredrawn in actual practice, the drawing workability is about 5% per pass. In view of the fact that steel of other types can be drawn generally in a workability of higher than 10%, the cold working efficiency of these types should be improved.

iv. It is essential for the commercialization of magnet materials to reduce the production cost as low as possible. The main metal elements comprising these types of alloys include cobalt, chromium and iron. The only source of cobalt is relied on metallic cobalt. Since iron is inexpensive inherently as compared other metals, no marked reduction in the production cost can be achieved by using an alternate material for the iron source. On the other hand, chromium sources include metallic chromium and alloy steel containing iron in an amount of about 40%, i.e., ferrochromium which can be easily available and used. The price of chromium is about 3 to 4 times as high as the net price of chromium in ferrochromium, so that the selection of chromium sources affects largely on the material cost. Since metallic chromium has a higher purity, the characteristics of alloys of these types are stabilized in the use of metallic chromium. Since, however, the material cost is increased, the use of metallic chromium is unfavorable in view of reducing the production cost as low as possible. On the other hand in the process employing ferrochromium as the chromium source, the material cost is inexpensive but it contains harmful contaminants such as nitrogen, carbon and the like, the magnetic characteristics become very unstable. Hence in view of the quality of alloys, ferrochromium cannot be usable as such.

In order to improve such problems, the inventors have found that such improvements can be achieved to a great extent by a process for producing the alloys wherein zirconium is added in the melting step.

It is thus an object of this invention to provide inexpensive magnetic materials in which the workability is improved and the production cost is reduced. Other objects and features of this invention will be apparent from the following description.

Compositions of the alloys to be applied in this invention comprise Co in the range from 10 to 35% and Cr in the range from 25 to 40%, the balance being iron for one type and Co in the range from 10 to 35%, Cr in the range from 25 to 40 and Si in the range from 0.3 to 2.0%, the balance being Fe for another type of the alloys. As mentioned hereinafter, such types of alloys are added with Zr in an amount from 0.03 to 3.5% by weight.

Figure 3:
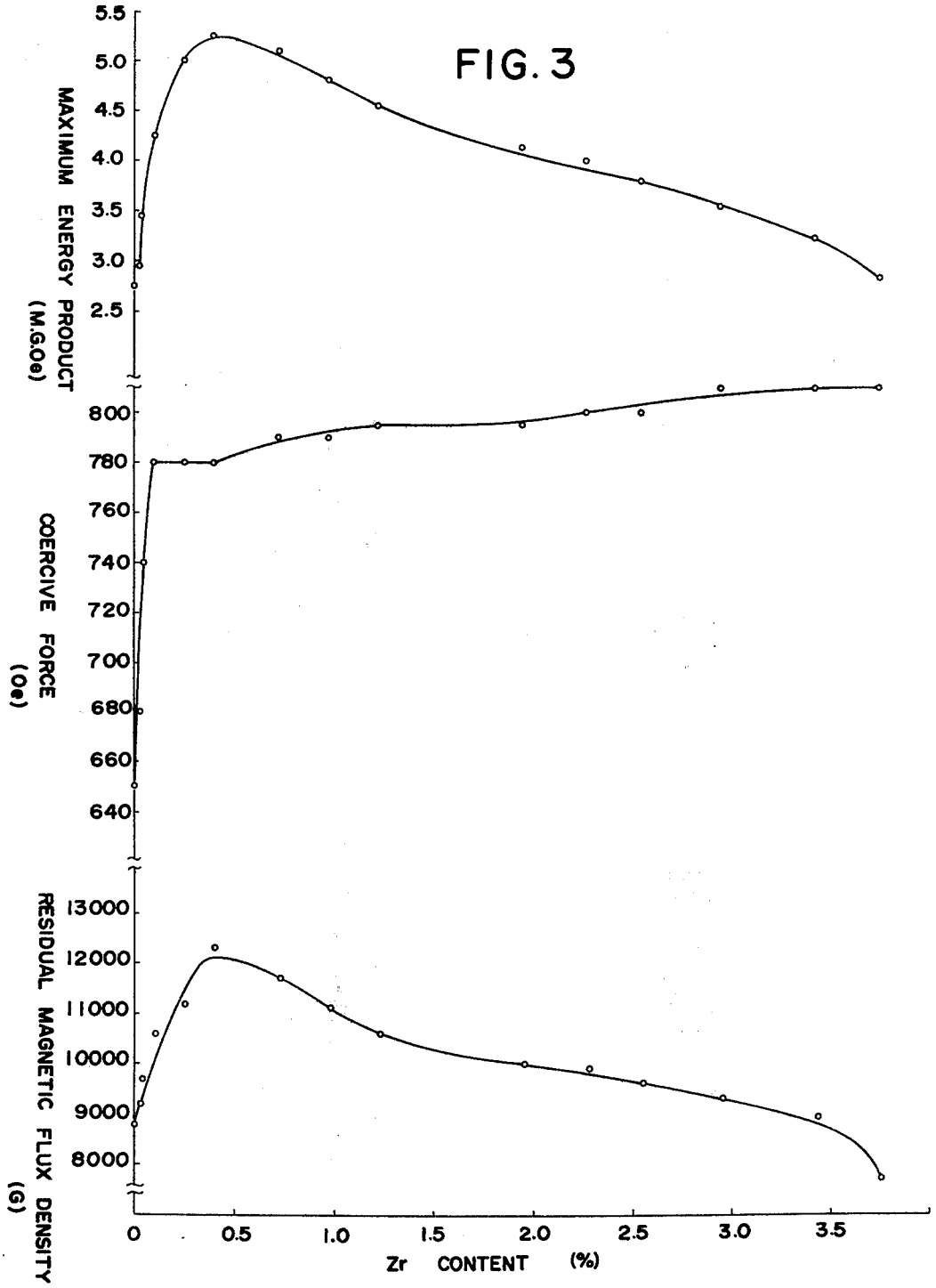

FIG. 3 curves showing relations between the Zr content and the residual magnetic flux density, coercive force and the maximum energy product.

The effects obtained by adding and including Zr according to this invention will be further illustrated by way of the following several examples.

EXAMPLE 1

12 Types of alloys having the following compositions were melted in a high frequency induction furnace by using metallic cobalt, metallic chromium, metallic silicon, metallic zirconium and pure iron and molded each in molds.

i.

3 Types of Fe-Cr-Co system which had been added with Zr;

3 Types of Fe-Cr-Co system without added with Zr;

ii.

3 Types of Fe-Cr-Co-Si system which had been added with Zr;

3 Types of Fe-Cr-Co-Si system without added with Zr.

Specimens were sampled in a size of a height of 10mm, a width of 10mm and a length of 15mm from the steel ingots to be subjected to the solution heat treatment.

The solution heat treatment was effected by maintaining the specimens at a temperature from 1400° to 1150° C each at an interval of 25° C for 30 minutes, followed by rapid cooling by throwing them into ice water at 4° to 5° C. The central section of cooled specimens was observed under an optical microscope to see whether the structure was formed from single $\alpha$-phase or a mixture of $\alpha$- and $\gamma$-phases to judge the susceptibility to the solution heat treatment. Additionally, in order to compare the magnetic characteristics, representative specimes were selected to be heat treated in the following treatment:

Solution heat treatment → Successive isothermal treatment in a magnetic field of 3000 Oe at 640° C for 40 minutes, multistage aging at 600° C for 1 hour, at 580° C for 1 hour, at 560° C for 1 hour and at 540° C for 5 hours.

Figure 1A:
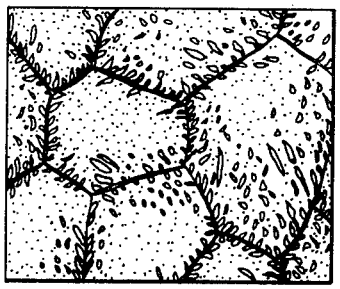
FIG. 1A is a diagram of microscopic structure (× 100) of Fe-Cr-Co or Fe-Cr-Co-Si type when no Zr is contained therein.
Figure 1B:
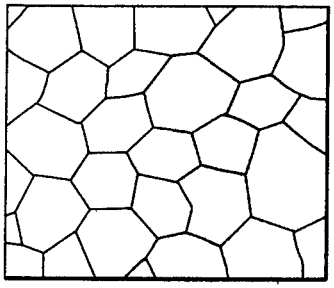
FIG. 1B is a diagram of similar structure as in that of FIG. 1A when Zr is contained in an amount of 0.49%.

Results obtained are shown in the following table and in FIG. 1 in which empty circles mean single $\alpha$-phase and solid circles means the coexistence of $\alpha$- and $\gamma$-phases.

| System | | Fe - Cr - Co System | | |
|---|---|---|---|---|
| Chemical composition % | Co | 23.10–23.00 | 21.17–21.20 | 28.08–28.09 |
| | Cr | 28.1–28.0 | 28.0–27.9 | 30.2–30.6 |
| | Si | — | — | — |
| Zr content,% | | — | 0.53 | — | 0.43 | — | 0.56 |
| Addition of Zr | | No | Yes | No | Yes | No | Yes |
| Solution heat treating temperature, ° C | | | | | | | |
| 1400 | | 0 | 0 | 0 | 0 | 0 | 0 |
| 1375 | | 0 | 0 | 0 | 0 | 0 | 0 |
| 1350 | | 0 | 0 | 0 | 0 | 0 | 0 |
| 1325 | | ● | 0 | 0 | 0 | 0 | 0 |
| 1300 | | ● | 0 | 0 | 0 | ● | 0 |
| 1275 | | ● | 0 | ● | 0 | ● | 0 |
| 1250 | | ● | ● | ● | 0 | ● | 0 |
| 1225 | | ● | ● | ● | 0 | ● | ● |
| 1200 | | ● | ● | ● | ● | ● | ● |
| 1175 | | ● | ● | ● | ● | ● | ● |
| 1150 | | ● | ● | ● | ● | ● | ● |

-continued

| System | | Fe - Cr - Co - Si System | | |
|---|---|---|---|---|
| Chemical composition, % | Co | 23.07–23.09 | 21.30–21.28 | 23.05–23.06 |
| | Cr | 28.0–27.9 | 27.9–28.0 | 30.3–30.5 |
| | Si | 1.02–1.00 | 0.98–0.97 | 0.97–0.95 |
| Zr content, % | | — | 0.49 | — | 0.47 | — | 0.39 |
| Addition of Zr | | No | Yes | No | Yes | No | Yes |
| Solution heat treating temperature, ° C | | | | | | | |
| 1400 | | 0 | 0 | 0 | 0 | 0 | 0 |
| 1375 | | 0 | 0 | 0 | 0 | 0 | 0 |
| 1350 | | 0 | 0 | 0 | 0 | 0 | 0 |
| 1325 | | 0 | 0 | 0 | 0 | 0 | 0 |
| 1300 | | 0 | 0 | 0 | 0 | 0 | 0 |
| 1275 | | ● | 0 | 0 | 0 | ● | 0 |
| 1250 | | ● | 0 | ● | 0 | ● | 0 |
| 1225 | | ● | 0 | ● | 0 | ● | 0 |
| 1200 | | ● | ● | ● | 0 | ● | ● |
| 1175 | | ● | ● | ● | ● | ● | ● |
| 1150 | | ● | ● | ● | ● | ● | ● |

Magnetic characteristic of the representative specimens are shown in the following tables.

| System | Fe - Cr - Co System | | | |
|---|---|---|---|---|
| Composition, % Co: 23.10 – 23.06; Cr: 28.1 – 28.0 | | | | |
| Zr content, % | | Nil | | |
| Characteristic | $\alpha$– or $\alpha$– + $\gamma$– phase | Residual magnetic flux density (Gauss) | Coercive force (oe) | Maximum energy product (M.G. Oe) |
| Solution heat treating temperature, ° C | | | | |
| 1350 | 0 | 12,600 | 510 | 4.8 |
| 1275 | ● | 8,100 | 500 | 2.1 |
| Composition, % Co: 23.10 – 23.06; Cr: 28.1 – 28.0 | | | | |
| Zr content, % | | 0.53 | | |
| Characteristic | $\alpha$– or $\alpha$– + $\gamma$– phase | Residual magnetic flux density, (Gauss) | Coercive force (oe) | Maximum energy product (M.G. Oe) |
| Solution heat treating temperature, ° C | | | | |
| 1350 | 0 | 12,500 | 640 | 4.5 |
| 1275 | 0 | 12,000 | 650 | 4.6 |

| System | Fe - Cr - Co - Si System | | | |
|---|---|---|---|---|
| Composition, % Co: 23.07–23.09; Cr: 28.0–27.9; Si: 1.02–1.00 | | | | |
| Zr content, % | | Nil | | |
| Characteristic | $\alpha$– or – + $\gamma$– $\alpha$ phase | Residual magnetic flux density, (Gauss) | Coercive force (oe) | Maximum energy product (M.G. Oe) |
| Solution heat treating temperature, ° C | | | | |
| 1300 | 0 | 12,500 | 620 | 5.2 |
| 1225 | ● | 8,300 | 560 | 2.5 |
| Composition, % Co: 23.07–23.09; Cr: 28.0–27.9; Si: 1.02–1.00 | | | | |
| Zr content, % | | 0.49 | | |
| Characteristic | $\alpha$– or $\alpha$– + $\gamma$– phase | Residual magnetic flux density, (Gauss) | Coercive force (oe) | Maximum energy product (M.G. Oe) |

-continued

| | | | | |
|---|---|---|---|---|
| Solution heat treating temperature, ° C | | | | |
| 1300 | 0 | 12,600 | 760 | 5.3 |
| 1225 | 0 | 11,800 | 730 | 5.2 |

As obvious from the above-mentioned example, it is possible for Fe-Cr-Co system to reduce the solution heat treating temperature by about 75° C by adding the system with Zr. The main magnetic characteristics can be maintained equally in the specimens in which the solution heat treating temperature is reduced by about 75° C by adding the specimens with Zr to those containing no Zr and which has been subjected to the solution heat treatment at the higher temperature of about 75° C. When the specimens containing no Zr are subjected to the solution heat treatment at the lower temperature to form $\gamma$-phase, the magnetic characteristics are deteriorated to make the specimens not to be employed in practical uses.

Similar phenomena are clearly applied for the Fe-Cr-Co-Si system. It is markedly contributable to the maintenance of equipments, workability and efficiency in the metal industry to enable the treating temperature to reduce by 75° C in the high temperature operation at about 1300° C.

EXAMPLE 2

From an alloy containing Co in an amount of 23% and Cr in an amount of 28% as the fundamental ingredients and an alloy containing the above-mentioned fundamental ingredients in the same amounts and further containing Si in an amount of about 1%, four types of alloys with and without containing Zr were melted. These melts were molded in 5 cubic molds each having a side of 10, 20, 30, 40 and 50mm, respectively.

These ingots were maintained at 1350° C for 30 minutes and then rapidly cooled by throwing them into ice water at 4° to 5° C or water at 20° to 22° C. Cooling conditions, size of specimens and effects of Zr addition were studied by microscopic observation of $\gamma$-phase developed in the structure.

The following table shows the results obtained, in which the empty circles mean single $\alpha$-phase and the solid circles mean mixed $\alpha$- and $\gamma$-phases.

| Composition, % | Co: 23.10; Cr: 28.0 | | Co: 23.08; Cr: 28.1; Si: 1.0 | | | | | |
|---|---|---|---|---|---|---|---|---|
| Zr content, % | Ni. | | 0.54 | | Nil | | 0.51 | |
| Cooling medium | Ice water | Water | Ice water | Water | Ice water | Water | Ice water | Water |
| Size of specimen | | | | | | | | |
| 10mm cube | ○ | ● | ○ | ○ | ○ | ○ | ○ | ○ |
| 20mm cube | ● | ● | ○ | ○ | ○ | ● | ○ | ○ |
| 30mm cube | ● | ● | ○ | ○ | ○ | ● | ○ | ○ |
| 40mm cube | ● | ● | ○ | ○ | ● | ● | ○ | ○ |
| 50mm cube | ● | ● | ○ | ○ | ● | ● | ○ | ○ |

It is clear from the above results that when the specimens contain Zr, $\gamma$-phase cannot be observed either cooled in ice water or water even the specimens have a size of 50mm cube. On the contrary, when the specimens contain no Zr, in either alloy of Fe-Cr-Co or Fe-Cr-Co-Si, $\gamma$-phase is developed even in the specimens of 10mm and 20mm cubes. It is shown as in Example 1 that the specimens containing $\gamma$-phase in such a manner are poor in the magnetic characteristics. This means in a manufacturing industries of materials that the more the size of product is restricted, the narrower the application range is. It can be said to have superior effect of Zr addition that the process is applicable to the production of articles having a larger size.

EXAMPLE 3

In a high frequency industion furnace, each one batch of Fe-Cr-Co-Si system was melted by using metallic cobalt, metallic chromium and pure iron to product a standard composition comprising 23% of Co, 28% of Cr and 1.0% of Si with and without adding metallic zirconium. The melts were then molded in molds having a square of 90mm and a length of 1000mm to obtain the ingots. Chemical composition of each ingot was respectively 22.9% of Co, 27.9% of Cr and 0.98% of Si, the balance being Fe and 23.01% of Co, 27.8% of Cr, 1.00% of Si and 0.72% of Zr, the balance being Fe.

The ingots were worked to remove the surface defects and then rolled into the billets having a square of 50mm through a blooming mill, followed by hot rolling into the rods having a diameter of 10mm. The initial temperature for the hot rolling was 1280° C and the final temperature was 980° C.

After cut into a length of 1000mm, each rod was maintained at 1300° C for 30 minutes and then cooled by throwing them into ice water to soften the hardness of material and to facilitate the cold rolling. Further in order to remove the oxidized film, the rods were pickled in hydrochloric acid to clean the surface to be ready for the cold drawing.

The cold drawing was effected through an alloy die having an inner diameter of 9.5mm by means of draw bench.

The specimens containing Zr and having a diameter of 10mm could be drawn easily, whereas those containing no Zr and having a diameter of 10mm could not be drawn by seizing on the die and being broken halfway. Similar specimens containing no Zr were drawn through a die having an inner diameter of 9.8mm, they could be drawn without being broken halfway.

The cold drawing was repeatedly effected and obtained similar results. From this, it has been found that the effect of Zr addition can improve the cold drawing a material.

Figure 2A:
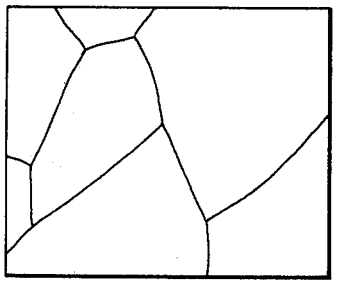
FIG. 2A is a diagram of microscopic structure (× 100) of Fe-Cr-Co-Si type after the solution heat treatment at 1300° C when no Zr is contained.
Figure 2B:
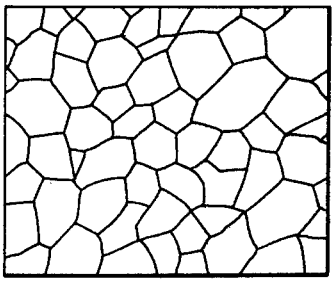
FIG. 2B is a diagram of similar structure as in FIG. 2A when Zr is contained in an amount of 0.72%.

FIG. 2 shows a microscopic structure of the specimen containing no Zr and that containing Zr after the solution heat treatment. It can be seen and supports the results of cold drawing that the grain size of specimen containing Zr is far smaller than that of specimen containing no Zr.

EXAMPLE 4

As a rule, production cost should be reduced as low as possible for commercial production. Hence in order to reduce the material cost, the melting was conducted in this example for Fe-Cr-Co-Si system on commercial scale by using Fe-Cr alloy containing Cr in an amount of 62% as the Cr source to compare the effects of Zr addition.

In a melting furnace, not metallic chromium as in the preceding examples but Fe-Cr alloy containing Cr in an amount of 62%, metallic cobalt, metallic silicon and pure iron were melted. One batch of such melt was added with Zr and another batch was added no Zr. The ingots of 90mm square were molded from the two types of melt.

After worked to remove the surface defects, the ingots were heated at 1280° C for 30 minutes and then rolled into the billet of 50mm square through a blooming mill, followed by hot rolling into the rods having a diameter of 12mm. The specimens having a diameter of 10mm and a length of 15mm were sampled from these rods and then subjected to the solution heat treatment by maintaining them at a temperature from 1350° to 1150° C each at an interval of 25° C for 30 minutes, followed by cooling rapidly by throwing them into ice water of 4° to 5° C. The structures were studied under microscopic observation of the resulting specimens. For representative specimens thereof, the heat treatment for imparting the magnetic characteristics was carried out and the magnetic characteristics were measured. The heat treatment was the same as the method as disclosed in Example 1. The following table shows the results.

| Chemical composition, % | Co: 23.15; Cr: 27.9; Si; 0.98 | | | |
|---|---|---|---|---|
| Zr content, % | | Nil | | |
| Characteristics | α– or α– + γ– phase | Residual magnetic flux density (Gauss) | Coercive force (oe) | Maximum energy product (M.G. Oe) |
| Solution heat treating temperature, ° C | | | | |
| 1350 | ● | — | — | — |
| 1325 | ● | — | — | — |
| 1300 | ● | — | — | — |
| 1275 | ● | — | — | — |
| 1250 | ● | 8,600 | 620 | 2.6 |
| 1225 | ● | 7,600 | 530 | 2.3 |
| 1200 | ● | 7,100 | 510 | 2.1 |
| 1175 | ● | — | — | — |
| 1150 | ● | — | — | — |

| Chemical composition, % | Co: 23.12; Cr: 28.1; Si: 0.99 | | | |
|---|---|---|---|---|
| Zr content, % | | 0.59 | | |
| Characteristics α+ γ | α– or phase | Residual magnetic flux density (Gauss) | Coercive force (oe) | Maximum energy product (M.G. Oe) |
| Solution heat treating temperature, ° C | | | | |
| 1350 | 0 | — | — | — |
| 1325 | 0 | — | — | — |
| 1300 | 0 | — | — | — |
| 1275 | 0 | — | — | — |
| 1250 | 0 | 11,800 | 720 | 5.1 |
| 1225 | 0 | 11,200 | 680 | 4.8 |
| 1200 | ● | 9,500 | 600 | 3.4 |
| 1175 | ● | — | — | — |
| 1150 | ● | — | — | — |

From these results, it is obvious that when Fe-Cr material is used as the chromium source, the effect of Zr addition is significant. Namely, when metallic chromium is used as in Example 1, the specimen having a composition of 23% of Co, 28% of Cr and 1% of Si can be solubilized by maintaining the specimen at 1300° C even in the absence of Zr, whereas when Fe-Cr is used as the chromium source, the specimen having the same composition is difficulty solubilized by the development of α- + γ-phases by the heat treatment at a higher temperature of 1350° C. Notwithstanding of this fact, the solution heat treatment can be achieved by maintaining the specimen at 1225° C in the presence of Zr. Thus it should be said in the use of Fe-Cr material as the chromium source that the effect of Zr is particularly remarkable.

It appears that harmful impurities such as carbon, nitrogen, oxygen and the like make the solution heat treatment difficult and that such adverse effect can be compensated by the addition of Zr.

The effects of Zr addition on the magnetic characteristics are obvious in this case.

EXAMPLE 5

The preceding Example 4 illustrates that inexpensive magnets having stable magnetic characteristics can be prepared by adding Zr in such an alloy system produced by using inexpensive Fe-Cr alloy as the chromium source.

This Example 5 illustrates an embodiment for reducing the production cost as Example 4. Examples 1 to 4 relate to alloy compositions containing Co within the range from 21 to 23%, this embodiment is characterized by reducing the Co to a content from 10 to 20% by using Fe-Cr alloy as the chromium source and adding Zr to reduce the production cost doubly and to stabilize or maintain the magnetic characteristics.

General procedure for imparting permanent magnetic characteristics to this alloy system includes melting, molding, working, solution heat treatment, followed by isothermal treatment in a magnetic or non-magnetic field. Subsequently, the single or multistage aging treatment is effect. It has been found that after the isothermal treatment in a magnetic or non-magnetic field, superior magnetic characteristics are provided by carrying out the aging treatment after the cold working such as swaging, rolling, drawing or wire drawing for the orientation of magnet materials to those in the absence of such cold working.

It has also been found that the magnetic characteristics can be maintained by such working procedure even when the content of cobalt is reduced to a considerable extent.

This example illustrate the effect of Zr addition on such an alloy system containing cobalt in a lesser content when the alloys are prepared by using Fe-Cr alloy as the chromium source and cold worked after the above-mentioned isothermal treatment.

In a high frequency induction furnace, 6 types of melt comprising the following compositions were prepared by using metallic cobalt, Fe-Cr alloy containing Cr in an amount of 62%, metallic silicon and pure iron with or without the addition of metallic Zr and molded into the ingots of 90mm square. After the removal of surface defects, the ingots were heated at 1280° C for 30 minutes and then rolled into the billets having a size of 50mm square through a blooming mill. The billets were then heated at 1280° C for 30 minutes and hot rolled through a hot rolling mill into the rods having a diameter of 9mm. The resulting rods were cut into a length of 30cm, heated at 1250° C for 30 minutes and cooled rapidly by throwing the specimens into water. The rods were then subjected to the isothermal treatment in a magnetic field of 2000 oe at 640° C for 40 minutes.

After pickled, the specimens were cold rolled through a draw bench by drawing them through dies having successively smaller inner diameters to obtain the rods having a diameter of 5.5mm. After cut into a length of 15mm, the specimens were subjected to aging treatment at 600° C for one hour, 580° C for 1 hour, 560° C for 1 hour and 540° C for 5 hours and then subjected to magnetic tests. The following table shows the results.

| Chemical composition of specimen % by weight | | | | | Magnetic characteristics | | |
|---|---|---|---|---|---|---|---|
| Co | Cr | Si | Zr | Fe | Residual magnetic flux density (Gauss) | Coercive force (oe) | Maximum energy product (M.G. Oe) |
| 7.08 | 28.1 | 0.99 | Nil | Bal | 8,100 | 430 | 1.3 |
| 10.12 | 27.9 | 1.01 | " | " | 9,600 | 480 | 2.3 |
| 15.08 | 27.9 | 0.96 | " | " | 12,800 | 560 | 4.6 |
| 7.02 | 28.2 | 0.98 | 0.59 | " | 8,400 | 450 | 1.4 |
| 10.13 | 28.0 | 1.07 | 0.48 | " | 10,100 | 540 | 3.1 |
| 15.19 | 27.9 | 1.02 | 0.61 | " | 13,200 | 620 | 5.5 |

From these results, it can be seen that the magnetic characteristics are superior for the specimens containing Co in amounts of 10 and 15% in the presence of Zr to in the absence of Zr, thus the effect of adding Zr is superior. When Co is contained in an amount of 7%, the magnetic characteristics are reduced irrespective of the presence or absence of Zr, hence the inherent effect as a magnet appears to become invalid when the content of Co is reduced to a value of less than 10%. The specimen containing Co in an amount of 15%, Cr in an amount of 28% and Si in an amount of 1% and added with Zr has the magnetic characteristics as a standard permanent magnet. It cannot be overlooked as an effect of Zr addition that the production cost can be reduced by a decrease in the Co content and by using Fe-Cr alloy.

EXAMPLE 6

Since the effects of Zr addition can be clearly achieved in these alloy systems, various types of alloy were prepared by adding Zr in various amounts to see the effective range of Zr content.

In a high frequency induction furnace, melts were prepared by using as raw materials, Fe-Cr alloy containing Cr in an amount of 61.3%, metallic cobalt, metallic silicon, metallic zirconium and pure iron on a scale of about 60kg/batch.

15 Types of specimen were prepared which contain Zr in various amounts including specimen including no Zr. The melts were molded into the ingots having a square of 15mm and a length of 100mm.

The same melt was added progressively with Zr and each when added with Zr in an aliquot, the specimen was sampled from the melt and then added with the subsequent aliquot of Zr from which the specimen was sampled. The specimens containing Zr in stepwisely increased amounts were thus prepared by repeating the addition of Zr.

Since the melting circumferential conditions can be regarded to be substantially the same in such a procedure, the effects of Zr addition might be grasped accurately from the measured values. Taking into account of the fact that Co-, Cr and Si-contents were decreased with increased amounts of Zr, Specimen No. 8 and the follows were added with metallic cobalt, Fe-Cr alloy and metallic silicon in calculated amounts so that the melt comprised the standard composition of Co in an amount of 23%, Cr in an amount of 28% and Si in an amount of 1.0% in expectation of decrease in the concentrations thereof.

The resulting specimens were subjected to the solution heat treatment at 1275° C for 30 minutes and them cooled rapidly by throwing into water at 4° to 5° C. Subsquently, the specimens were subjected to the isothermal treatment in a magnetic field of 3000 oe at 640° C for 40 minutes, and then the aging treatment at 600° C for 1 hour, 580° C for 1 hour, 560° C for 1 hour and 540° C for 5 hours. Magnetic measurments were conducted for these treated specimens.

The following table shows the results of measurements.

| Specimen No. | Accumulative amount of Zr, % | Chemical composition, % | | | | Magnetic characteristics | | |
|---|---|---|---|---|---|---|---|---|
| | | Zr | Co | Cr | Si | Residual magnetic flux density (Gauss) | Coercive force (oe) | Maximum energy product (m.g.Oe) |
| 1 | 0 | 0 | 23.0 | 28.4 | 1.02 | 8,800 | 650 | 2.75 |
| 2 | 0.05 | 0.020 | 22.9 | 28.4 | 1.00 | 9,200 | 680 | 2.95 |
| 3 | 0.10 | 0.035 | 22.9 | 28.4 | 1.01 | 9,700 | 740 | 3.45 |
| 4 | 0.20 | 0.120 | 22.9 | 28.3 | 0.99 | 10,600 | 780 | 4.25 |
| 5 | 0.40 | 0.250 | 22.9 | 28.3 | 1.00 | 11,200 | 780 | 5.00 |
| 6 | 0.60 | 0.410 | 22.8 | 28.2 | 0.98 | 12,300 | 780 | 5.25 |
| 7 | 0.90 | 0.720 | 22.7 | 28.1 | 0.99 | 11,700 | 790 | 5.10 |
| 8 | 1.20 | 0.950 | 22.8 | 28.0 | 1.02 | 11,100 | 790 | 4.80 |
| 9 | 1.50 | 1.220 | 22.9 | 28.0 | 1.01 | 10,600 | 795 | 4.55 |
| 10 | 2.20 | 1.930 | 22.8 | 27.9 | 1.00 | 10,000 | 795 | 4.15 |
| 11 | 2.50 | 2.260 | 22.7 | 27.9 | 1.01 | 9,900 | 800 | 4.01 |
| 12 | 3.00 | 2.560 | 22.8 | 27.6 | 0.98 | 9,600 | 800 | 3.80 |
| 13 | 3.50 | 2.940 | 22.9 | 28.0 | 0.98 | 9,300 | 810 | 3.55 |
| 14 | 4.00 | 3.420 | 22.8 | 27.9 | 0.98 | 8,900 | 810 | 3.25 |
| 15 | 4.50 | 3.740 | 22.9 | 28.0 | 0.99 | 8,200 | 810 | 2.85 |

As mentioned in the preceding examples, the addition of Zr is effective in the fundamental characteristics, i.e., the magnetic characteristics for these alloy system.

It has been demonstrated by the preceding examples that the addition of Zr achieves markedly improved effects on the easiness of solution heat treatment, improved mass effect, efficiency during the cold drawing operation and a decrease in the production cost by the use of low price materials.

Although the addition of Zr is effective as shown hereinabove, when contained in an excessive amount, Zr forms compounds between Zr and other metallic elements to deteriorate the magnetic characteristics, which are main characteristics of these alloy system. Thus it is impractical to add Zr in an amount of higher than certain limit. Such upper limit is specified as to be 3.50% by weight in this invention.

On the other hand, when Zr is reduced to a content of less than 0.03%, the effect of Zr addition is weakened or becomes insignificant, so that the lower limit is established to be 0.03% in this invention.

FIG. 3 shows relations between the Zr content and residual magnetic flux density, coercive force and maximum energy product obtained from these examples.

Thus the effective range of Zr addition ranges from 0.03 to 3.5% by weight in this invention.

In short, the addition of Zr can provide very advantageous improvements in the commercialization of these alloy systems.

What we claim is:

1. A ductile permanent magnetic composition exhibiting a residual flux density greater than 10,100 gauss and a coercive force greater than 540 that can be cold drawn from a specimen diameter of 10 mm through a die having a diameter of less than 9.8 mm without breaking and is characterized by small grain structure in the $\alpha$ phase when cooled in water in the order of 20° C. which composition consists essentially of 0.03 to 3.5% by weight of zirconium, 10 to 35% by weight cobalt, 25 to 40% by weight chromium and the balance being iron and incidental impurities.

2. The magnetic composition of claim 1 including therein 0.3 to 2.0% by weight silicon.

3. The magnetic composition of claim 1 wherein cobalt is present in an amount from 21 to 24% by weight, chromium is present in an amount from 27 to 28% by weight, and zirconium is present in an amount from 0.4 to 0.6% by weight.

4. The magnetic composition of claim 2 wherein cobalt is present in an amount from 21 to 24% by weight, chromium is present in an amount from 27 to 31% by weight, silicon is present in an amount from 0.9 to 1.1% by weight, and zirconium is present in an amount from 0.4 to 0.6% by weight.

5. The magnetic composition of claim 2 wherein cobalt is present in an amount from 10 to 20% by weight, chromium is present is an amount from 27 to 28% by weight, silicon is present in an amount from 0.9 to 1.1% by weight, and zirconium is present in an amount from 0.48 to 0.61% by weight.

* * * * *